United States Patent [19]

Hoeger et al.

[11] 4,056,430

[45] Nov. 1, 1977

[54] PROCESS OF PREVENTING FORMATION OF RESINOUS DEPOSITS IN THE MANUFACTURE OF PAPER AND THE LIKE, AND COMPOSITIONS

[75] Inventors: Ernst Hoeger, Neuhofen; Franz Baskovic, Goennheim, both of Germany

[73] Assignee: Benckiser-Knapsack GmbH, Ladenburg am Neckar, Germany

[21] Appl. No.: 551,685

[22] Filed: Feb. 21, 1975

[30] Foreign Application Priority Data

Feb. 22, 1974 Germany ..... 2408523

[51] Int. Cl.[2] ..... D21C 9/00; D21H 3/08; D21H 3/68

[52] U.S. Cl. ..... 162/76; 162/80; 162/158; 162/181 R; 162/181 A; 162/DIG. 4.

[58] Field of Search ..... 162/158, 76, 80, 190, 162/DIG. 4, 181 R, 181 A; 210/54, 58; 252/DIG. 11, DIG. 17, 181

[56] References Cited

U.S. PATENT DOCUMENTS

| | | | |
|---|---|---|---|
| 3,234,124 | 2/1966 | Irani | 210/58 |
| 3,639,645 | 2/1972 | Miller et al. | 210/58 |
| 3,751,372 | 8/1973 | Zechner | 210/58 |
| 3,784,469 | 1/1974 | Krueger et al. | 210/58 |
| 3,804,770 | 4/1974 | Lorenc et al. | 210/58 |
| 3,812,055 | 5/1974 | Carstens et al. | 162/181 B |
| 3,832,393 | 8/1974 | Krueger et al. | 210/58 |
| 3,832,396 | 8/1974 | Irani et al. | 260/545 P |
| 3,873,417 | 3/1975 | Otrhalek et al. | 162/168 |
| 3,896,046 | 7/1975 | Carstens et al. | 252/310 |

OTHER PUBLICATIONS

*Tappi*, vol. 47, No. 1, Jan. 1964, pp. 198A–201A.
*Tappi*, vol. 39, No. 10, Oct. 1956, pp. 684–690.

*Primary Examiner*—S. Leon Bashore
*Assistant Examiner*—William F. Smith
*Attorney, Agent, or Firm*—Bacon & Thomas

[57] ABSTRACT

The difficulties encountered in the manufacture of paper, cardboard, and other cellulosic articles, as they are caused by the formation of resinous or pitch deposits on the paper as well as on the paper machines and processing apparatus, are overcome, or at least considerably reduced, by the addition of phosphonic acids and more particularly of alkyl, amino or hydroxy alkyl, or cycloalkyl phosphonic acids or their alkali metal salts. If required, amino polycarboxylic acids, hydroxy carboxylic acids, or their alkali metal salts, or alkali metal polyphosphates are also added during processing.

22 Claims, No Drawings

PROCESS OF PREVENTING FORMATION OF RESINOUS DEPOSITS IN THE MANUFACTURE OF PAPER AND THE LIKE, AND COMPOSITIONS

BACKGROUND OF THE INVENTION

1. FIELD OF THE INVENTION

The present invention relates to a composition useful for preventing formation of resinous or pitch deposits and more particularly to a composition for preventing formation and separation of resinous or pitch deposits in the manufacture of paper, cardboard, boxboard, and the like cellulosic material, and to a process of preventing formation and separation of such resinous or pitch deposits.

2. DESCRIPTION OF THE PRIOR ART

The formation of resinous precipitates and deposits, i.e. of so-called pitch deposits presents a problem of considerable importance in the paper industry. These difficulties are caused by the presence of resins in the paper pulp or mechanical wood pulp and the like cellulosic raw materials. Resinous deposits originate also from residual sizing material which has not been completely utilized in paper sizing. The resinous materials coagulate and more deposited on and incrustate the pipelines and the walls of the stock preparation plants and vats and the screen, felts, presses, and drying cylinders of the paper machines. Precipitation of the resinous material results in soiling and in rendering sticky the apparatus used, in inhibiting the removal of water from the cellulosic material, in the formation of stains and pitch spots on the paper, and frequently in tearing and breaking of the paper resulting in faulty manufacture and defective final products and thus in production breakdown and losses.

Attempts have been made to overcome these difficulties by adding to the cellulose or paper pulp absorbents such as, for instance, kaolin or china clay. Addition of such absorbents decreases the stickiness of the precipitation resinous impurities or pitch. But such addition does not prevent separation and deposition of the resinous materials as such apart from the fact that addition of kaolin is undesired in the manufacture of many types of paper.

Furthermore, attempts have also been made to add to the paper pulp alkali metal polyphosphates, the solution of which had been adjusted to a pH-value between a pH of about 5.0 and about 8.0 in order to achieve the same results. Such addition is disclosed, for instance, in German Pat. No. 740,833.

Finally, it has been tried to overcome the difficulties caused by the precipitation of resinous materials by means of finely divided magnesium silicates.

All these additives, however, are capable of preventing formation of resinous precipitates and pitch deposits to a certain extent only. They fail to work especially if the manufacturing conditions are exceptionally difficult, for instance, if the water is of inferior quality, for instance, of a high degree of hardness, has a high content of polyvalent cations, such as iron, manganese, and the like ions, or is contaminated by humic acids, or if the manufacture of paper, cardboard, and the like materials takes place at higher temperatures or at unusual pH ranges.

SUMMARY OF THE INVENTION

It is one object of the present invention to provide a simple and effective process of preventing formation and separation of such resinous precipitates and pitch deposits even under extremely unfavorable manufacturing conditions.

Another object of the present invention is to provide a composition for carrying out said process.

Other objects of the present invention and advantageous features thereof will become apparent as the description proceeds.

In principle the process according to the present invention comprises the addition of phosphonic acids and preferably of phosphonic acids of Formula I:

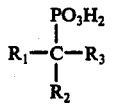

I in which $R_1$ is hydrogen, lower alkyl such as $—CH_3$ or $—(CH_2)_n.CH_3$, the amino group $—NH_2$, hydroxy methyl $—CH_2OH$, a lower alkanoic acid group $—(CH_2)_n.COOH$, a lower alkyl phosphonic acid group $—(CH_2)_n—PO_3H_2$, or a group of the formula

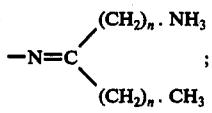

$R_2$ is hydrogen, hydroxyl-OH, the phosphonic acid group $—PO_3H_2$, a lower alkanoic acid group $—(CH_2)_n.COOH$, or a group of the formulas

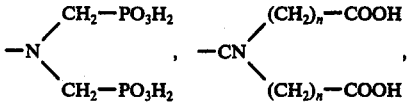

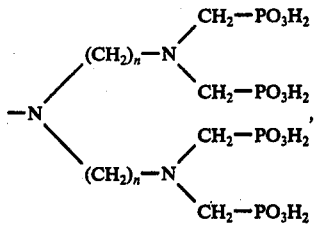

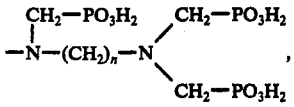

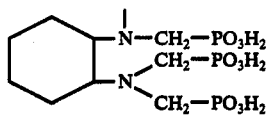

or

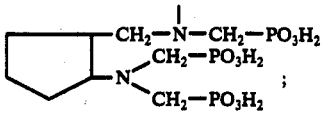

$R_3$ is hydrogen, hydroxyl —OH, the amino group $—NH_2$, lower alkyl such as $—CH_3$ or $—(CH_2)_n—CH_3$, a lower alkanoic acid group $—(CH_2)_n—COOH$, or the groups of the formulas $-NH-(CH_2)_n-PO_3H_2$;

$-NH-CH_2-COOH$, or

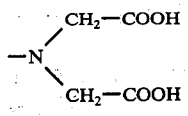

; and and $n$ is one of the numerals 0 to 6, preferably 0 to 3, to the cellulose pulp, mechanical wood pulp, or ground wood during its processing. Such phosphonic acids of Formula I are added either alone or together with amino polycarboxylic acids and/or hydroxy carboxylic acids or their alkali metal salts to the pulp.

Phosphonic acids of the above given Formula I are, for instance, amino methane diphosphonic acid,
amino tris-methylene phosphonic acid,
diethylene triamino penta-methylene phosphonic acid,
propylene diamino tetra-methylene phosphonic acid,
ethylene diamino tetra-methylene phosphonic acid,
1,2-cyclohexane diamino tetra-methylene phosphonic acid,
1-amino methyl cyclopentyl amino(2)-tetra-methylene phosphonic acid,
N-phosphono methane-1-amino ethane-1,1-diphosphonic acid,
1-amino ethane-1,1-diphosphonic acid,
acetamidino ethane diphosphonic acid.

As compounds which are free of nitrogen there have proved to be especially effective 1-hydroxy ethane-1,1-diphosphonic acid and
1-hydroxy propane-1,1,3-triphosphonic acid.
Carboxy alkane amino alkane phosphonic acids such as bis-N-carboxy methane amino ethane diphosphonic acid or
phosphono butane tricarboxylic acid can also be used for the purpose of the present invention.

Useful hydroxy carboxylic acids which can additionally be employed in the process according to the present invention are, for instance, gluconic acid, citric acid, tartaric acid, lactic acid, and the like acids.

More particularly ethylene diamino tetra-acetic acid (EDTA), diethylene triamino penta-acetic acid (DTPA), and nitrilo-tri-acetic acid (NTA) have proved valuable amino polycarboxylic acids additionally to be used in the present process.

The phosphonic acids according to Formula I given hereinabove, exhibit, when used alone, excellent preventive power. Their activity is further considerably increased when used in combination with the above mentioned hydroxy carboxylic acids and/or amino polycarboxylic acids, or also with polyphosphates. Such combinations show a noteworthy synergistic effect which considerably exceeds the additive effect.

Likewise, dispersing or wetting agents such as, for instance, alkyl phenol polyglycolic ethers can also be additionally employed in order to increase the activity of above mentioned phosphonic acids.

The amounts of phosphonic acids which are required are between about 0.02 and about 1.0% and preferably between about 0.04 and about 0.3%, calculated for dry cellulosic material.

When using a mixture of phosphonic acids, polyamino carboxylic acids, and hydroxy carboxylic acids or, respectively, the alkali metal salts of said acids, the mixing proportion can vary considerably. Especially advantageous has proved a mixture in which the proportion of phosphonic acid to the other components is between about 1 : 10 to about 10 : 1. Especially preferred are the amino (lower) alkyl phosphonic acids with 2 to 6 carbon atoms in their carbon chain, diethylene tri-amino penta-acetic acid, and gluconic acid or their alkali metal salts in the above mentioned mixing proportion.

In order to demonstrate the advantages and superiority of the process according to the present invention, the following simple comparative tests were carried out according to the method of Gustafson, described in detail in the journal "PAPPER och Troe" No. 4a, pp. 121 to 128 (1952).

According to said publication the difficulties encountered by the presence of resin during processing are increased considerably with an increasing pH-value of the fiber suspension, i.e. they are more pronounced at a pH of 7.0 than at a pH of 4.5. For this reason the comparative tests were carried out at a pH of 7.0 and the above mentioned method was further modified by using, in place of a copper apparatus, a glass beaker provided with a copper stirrer ("svensk Papperstidning" vol. 59, No. 9 (1956) p. 324.

COMPARATIVE TESTS

Test Series (a)

100 g. of unbleached sulfite pulp which does not contain large amounts of resin but nevertheless tends to deposit resinous material, are mixed in a laboratory Hollander beater with 2.4 l. of water wherein they are shredded and frayed without grinding. The resulting fiber suspension was placed into a 3 l. glass beaker and was adjusted to a pH-value of 7.0 by the addition of N sodium hydroxide solution or, respectively, N hydrochloric acid solution. Thereafter, the fiber suspension was stirred with a cleaned copper laboratory stirrer for two hours, whereupon the resin deposited on the stirrer, was removed therefrom and its weight was determined.

Test 1

0.3 g., corresponding to 0.3%, of Graham salt $(NaPO_3)_n.H_2O$ dissolved in 10 cc. of water were added, before beating, to a cellulose suspension prepared as described hereinabove.

Test 2

0.3 g. of tetra-sodium pyrophosphate ($Na_4P_2O_7$) were added, in place of the Graham salt, while the procedure was the same as described in Test 1.

Test 3

The same amount of diethylene tri-amino pentamethylene phosphonic acid adjusted to a pH value of 9.0 by the addition of sodium hydroxide solution, was used, in place of the Graham salt, as the additive to the cellulose suspension.

Test 4

0.3 g. of ethylene diamino tetra-methylene phosphonic acid adjusted to a pH value of 9.0 by the addition of sodium hydroxide solution, was used, in place of the Graham salt, in this test.

The comparative tests wre carried out twice at two different temperatures, namely at 20° and at 45° C. Determination of the resin deposited on the copper stirrer yielded the following values:

| Additive | Deposited Resin at 20° C. | Deposited Resin at 45° C. |
|---|---|---|
| Without addition | 4.1 mg. | 8.0 mg. |
| Graham salt | 2.6 mg. | 4.9 mg. |
| Tetra-sodium pyrophosphate | 3.7 mg. | 6.3 mg. |
| Diethylene triamino penta-methylene phosphonic acid | 1.4 mg. | 2.7 mg. |
| Ethylene diamino tetra-methylene phosphonic acid | 1.2 mg. | 2.6 mg. |

It is evident from these test results that addition of the phosphonic acids according to the present invention is capable to reduce deposition of resinous material by 60 to 70% while the other additives result only in a considerably smaller reduction of the resinous deposition.

COMPARATIVE TEST

Test Series (b)

A similar test series was carried out with a cellulose pulp containing especially high amounts of resinous material.

200 g. of such a highly resinous cellulose pulp were processed by beating in a beater to yield a 4% fiber suspension. This suspension was subdivided into two portions, each portion containing 100 g. of cellulose, in order to determine the resin deposition with and without the addition of agents according to the present invention by means of the above described method.

0.2 g. of a solution containing 0.014 g. of diethylene tri-amino penta-methylene phosphonic acid, 0.039 g. of sodium gluconate, and 0.027 g. of diethylene tri-amino penta-acetic acid which solution was adjusted to a pH value of 9.1 by the addition of sodium hydroxide solution, was used as additive to said cellulose suspension.

Without any addition, the amount of resin deposited was 340 for 100 g. of cellulose. When adding thereto the above mentioned solution of additives, the amount of deposited resin was reduced to 95 mg. for 100 g. of cellulose.

Thus, the amount of resinous deposit is reduced, according to the present invention, to only about 28% of the amount deposited without any additive.

DESCRIPTION OF THE PREFERRED EMBODIMENTS

The following examples show that the additives according to the present invention are even more effective under manufacturing conditions than in laboratory tests as has been proven in many large scale operations.

Of course, the present invention is not limited to said examples which merely serve to illustrate the same.

EXAMPLE 1 a. 9.600 l. of water and 400 kg. of a mixture consisting of 30 parts of bleached sulfate (bleached Kraft cellulose, 50 parts of bleached sulfite pulp, and 20 parts of unbleached sulfite pulp are filled into a batch Hollander beater. The mixture was beaten to 35° Schopper-Riegler. 12.0 k. of commercial, partly saponified rosin size and sufficient aluminum sulfate were added thereto until the pH of the mixture was 4.8. About 0.9 kg. to 1.0 kg. of aluminum sulfate are usually required.

A paper of 30 g./sq.m. was made from the resulting stock on a Fourdrinier paper machine for a period of 24 hours, i.e. the same kind of paper was produced on said machine during a period of time of 24 hours. Difficulties due to resin deposition on the Fourdrinier paper machine occurred already after the first few hours. These difficulties consisted in the formation of small pitch spots on the paper machine screen. Said spots caused many small holes in the paper so that the paper could not be used and that part of the production had to be recycled as waste into the production process. Due thereto, the machine had to be stopped and the screen had to be cleaned with carbon tetrachloride. Stopping and cleaning had to be repeated three times within 24 hours.

b. A paper pulp was produced in the same manner as described hereinabove under (a). However, after beating, a mixture of 0.2 kg. of diethylene tri-amino penta-methylene phosphonic acid, 0.68 kg. of sodium gluconate, and 0.24 kg. of diethylene tri-amino penta-acetic acid were added thereto in the form of a 40% solution which had been adjusted to a pH-value between 9.0 and 9.5 by the addition of potassium hydroxide solution. The cellulose pulp and the additive were thoroughly mixed with each other in the Hollander beater for about 10 minutes.

So much of said stock preparation was produced in the manner described hereinabove, that the type of paper mentioned under (a) could be produced for 4 days. During the entire operation according to this experiment it was not necessary to stop the machine. No breaking or tearing of the paper occurred and the paper produced was free of holes. No waste was produced which had to be recycled into the production process. At no place of the paper machine there could be visually observed any resin deposition. All the heretofore known agents for preventing resinous deposition did not show any results similar to those achieved according to the present invention.

EXAMPLE 2 a. Unbleached sulfite pulp was beaten in a beater and refined to 50° Schopper-Rieger. Said cellulose pulp was mixed with separately processed mechanical pulp (ground wood) and kaolin in a mixing vat in the proportion of 30 parts of cellulose, 55 parts of mechanical pulp, and 15 parts of kaolin. After addition of 2% of commercial, reinforced rosin size, the pH-value of the stock material was adjusted to a pH of 4.5 by the addition of aluminum sulfate. A paper of 80 g./sq.m. was produced from said stock preparation. During its manufacture, there occurred tearing of the paper at intervals of 8 to 12 hours. After cleaning the screens of the paper machine, the paper was no more torn; but tearing occurred again after a few hours.

b. In this test series there was added to the above described stock preparation, after beating, the sodium salt of ethylene di-amino tetra-methylene phosphonic acid as agent for preventing resin deposition in such a manner that there was supplied continuously to the fiber supply pipe a 25% solution of the sodium salt of ethylene di-amino tetra-methylene phosphonic acid by means of a dosing pump in a amount of 20 g./minute for 40 kg. of fiber slurry supplied per minute. The amount of additive thus is 0.05% calculated for dry paper stock.

When preceeding in this manner there were not observed any difficulties due to pitch deposition, even when operating continuously during a period of time of several weeks.

EXAMPLE 3

250 kg. of bleached sulfite pulp known for its property of continuously causing difficulties due to resin deposition were beaten in a Hollander beater at a pulp consistency of 3% to about 78° Schopper-Riegler, i.e. so as to form a well beaten pulp suitable for producing dense sheets of the parchment-like paper. The pH-value of the slurry was 6.0.

Before starting beating, 0.5 kg. of the sodium salt of phosphono butane tri-carboxylic acid were added to the slurry in the Hollander beater. After beating and refining 0.8 kg. of the same sodium salt of phosphono butane tri-carboxylic acid were admixed thereto.

When proceeding in this manner, there were observed no resinous deposits on the Hollander beater walls, nor in the pipe lines, nor on the paper machine.

EXAMPLE 4

120 kg. of unbleached sulfite pulp and 80 kg. of bleached sulfite pulp were added to 3,800 l. of water in a Hollander beater and the mixture was beaten to 40° Schopper-Riegler.

Before starting with beating the pulp, 3 kg. of a 10% solution of a sodium polyphosphate of an average degree of condensation of 8 and 0.5 kg. of a 20% solution of the sodium salt of N-phosphono methylene-1-amino methane-1,1-diphosphonic acid were added to the fiber pulp mixture.

After beating and sizing with 4% of rosin size, the slurry was discharged from the Hollander beater into the stock vat. The same amount of bleached and unbleached sulfite pulp and of water as well as of additive were processed in the Hollander beater as described hereinabove and again discharged into the stock vat. The thus collected paper stock was then processed on the paper machine to paper. Although the sulfite pulp used was known to cause considerable difficulties due to resin deposition, which caused tearing and holes in the paper, no such disadvantages and defects were observed during the entire paper manufacture with the stock preparation according to this example.

The same or similar advantageous results were observed with other phosphonic acids, preferably alkyl phosphonic acids, amino alkyl phosphonic acids, hydroxy alkyl phosphonic acids, and especially and most advantageously those phosphonic acids as illustrated by Formula I given hereinabove either alone or in combination with amino polycarboxylic acids and/or hydroxy carboxylic acids or their alkali metal salts.

The effective agents, i.e. the phosphonic acids and, if desired, the amino polycarboxylic acids, the hydroxy carboxylic acids, their alkali metal salts, and/or the alkali metal polyphosphates, can be added to the paper pulp to be processed either separately or in the form of a premanufactured mixture. The preventing agents can be added at any stage of processing the pulp. For instance, the agents can be admixed in the cellulose pulp manufacture to the cooking acid or liquor, to the chips, or during washing or refining, such as bleaching. The resinous deposit preventive agents can also be added during ground wood pulp manufacture to the grinding water or to the freshly prepared ground wood pulp (mechanical wood pulp).

When making paper, the preferred and most effective place of adding said agents is dependent on the place where the greatest separation and deposition of resin take place. Usually the agents are added to the Hollander beater or the pulping apparatus. But addition can also be made to the pulp vat or to the head box, i.e. the box supplying the stock material depending upon the manufacturing conditions.

The pH-value of the paper stock may be, for instance, at a constant pH between 4.5 and 8.0. Depending upon manufacturing conditions these values may also be higher or lower.

The preferred alkali metal polyphosphates to be added according to the present invention are salts of those acids which correspond to the formula $H_{n+2}P_nO_{3n+1}$ in which formula $n$ indicates a numeral between 2 and about 60. Compounds of this type are, for instance, the alkali metal salts of diphosphoric acid, triphosphoric acid, tetraphosphoric acid, and medium to high molecular polyphosphoric acids.

Especially useful have proved the alkali metal polyphosphates of the formula $Me_{10}P_8O_{25}$, although the polyphosphate addition is not limited to such salts.

It may be mentioned that, for instance, when operating at a higher pH-value, such as a pH of 9.0 to 9.5, the alkali metal salts and, under suitable conditions, the ammonium salts of the phosphonic acids can be added in place of adjusting the solution of said acids to such a pH-value as this is described hereinabove in Example 1(b).

Although the proportion of phosphonic acid to amino polycarboxylic acids, hydroxy carboxylic acids, or their alkali metal salts can vary considerably, as stated hereinabove, a proportion between about 1:6 and about 6:1 has proved to be the preferred proportion.

The partly saponified rosin size as used in Example 1 is a commercially available, 40% emulsion of saponified and non-saponified rosin (colophony) in which the non-saponified portion of the rosin size amounts, for instance, to about 20%. Other rosin sizes as they are used in paper mills can, of course, also be used.

The commercially available, reinforced rosin size used in Example 2 may be, for instance, a rosin size modified by maleic acid anhydride. Other modified rosin sizes can also be used.

The amount of aluminum sulfate to be added together with the rosin size, as it is used, for instance, in Example 1 is usually about one sixth of the amount of dry rosin size although it is not limited to such an amount.

It may be mentioned that, although the phosphonic acids as listed hereinabove have proved to be especially useful for carrying out the present invention, there can be employed other phosphonic acids, such as, for instance, Di-propylene triamino penta-methylene phosphonic acid,
1,2-bis-(amino methyl) cyclobutyl tetra-methylene phosphonic acid,
1,3-diamino-2-propanol tetra-methylene phosphonic acid and the like alkylene di- and polyamino polymethylene phosphonic acids,
amino di-(methylene phosphonic acid),
amino tris-(ethylidene phosphonic acid),
amino tris-(isopropylidene phosphonic acid), diamino diethyl sulfido tetra-methylene phosphonic acid, 1-hydroxy ethane-1,1,2-triphosphonic acid and others.

We claim:

1. In a process of preventing formation of resinous deposits and overcoming pitch trouble from a resin-containing cellulosic starting material in the manufacture of paper, cardboard, boxboard and the like, said process comprising adding to the resin-containing cellulosic starting material during processing a water-soluble additive consisting essentially of a phosphonic acid compound selected from an alkylene amino phosphonic acid or an alkali metal or ammonium salt thereof in an amount between about 0.02 and about 1.0%, calculated for dry cellulosic material.

2. The process of claim 1, wherein said additive further comprises a carboxylic acid compound selected from the group consisting of amino polycarboxylic acids, hydroxy carboxylic acids, and their alkali metal salts, the ratio of said alkylene amino phosphonic acid compound and said carboxylic acid compound being between about 1:10 and 10:1.

3. The process of claim 2, wherein said water soluble additive consists of said alkylene amino phosphonic acid compound and said carboxylic acid compound.

4. The process of claim 2, wherein a portion of said carboxylic acid compound is replaced by an alkali metal polyphosphate.

5. The process of claim 2, wherein said carboxylic acid compound is selected from the group consisting of gluconic acid, citric acid, tartaric acid, lactic acid, ethylene diamino tetra-acetic acid, diethylene triamino penta-acetic acid, and nitrilo-tri-acetic acid.

6. The process of claim 2, in which the agent preventing formation of resinous deposits during processing is a mixture of diethylene tri-amino penta-methylene phosphonic acid, diethylene triamino penta-acetic acid, and gluconic acid.

7. The process of claim 6, in which the alkali metal salts of said mixture of acids are added.

8. The process according to claim 1, in which the amount of additive is between about 0.04 and about 0.3%.

9. The process of claim 1, in which the amount of additive is between about 0.04 and about 0.3%.

10. The process of claim 1, wherein said additive further comprises an alkali metal polyphosphate, the ratio of said alkylene amino phosphonic acid compound and said alkali metal polyphosphate being between about 1:10 and 10:1.

11. The process of claim 10, wherein said water soluble additive consists of said alkylene amino phosphonic acid compound said carboxylic acid compound and said alkali metal polyphosphate.

12. The process of claim 10, wherein said polyphosphate is of the formula $H_{n+2}P_nO_{3n+1}$ wherein $n$ is a number between 2 and about 60.

13. The process of claim 12, wherein said alkali metal polyphosphate has the formula $Me_{10}P_8O_{25}$ where Me is an alkali metal.

14. The process of claim 1, in which the agent preventing formation of resinous deposits during processing is an alkali metal salt of said phosphonic acids.

15. The process of claim 1, in which the agent preventing formation of resinous deposits during processing is diethylene triamino pentamethylene phosphonic acid.

16. The process of claim 1, in which the agent preventing formation of resinous deposits during processing is ethylene diamino tetra-methylene phosphonic acid.

17. The process of claim 1, in which the agent preventing formation of resinous deposits during processing is phosphono butane tri-carboxylic acid or its alkali metal salts.

18. The process of claim 1, in which the agent preventing formation of resinous deposits during processing is N-phosphono methylene-1-amino methane-1,1-diphosphonic acid or its alkali metal salts.

19. The process of claim 1, in which the agent preventing formation of resinous deposits during processing is a mixture of an alkali metal salt of N-phosphono methylene-1-amino methane-1,1-diphosphonic acid and an alkali metal polyphosphate.

20. The process of claim 1, wherein said alkylene amino phosphonic acid compound is selected from the group consisting of amino methane diphosphonic acid,
amino tris-methylene phosphonic acid,
diethylene triamino penta-methylene phosphonic acid,
propylene diamino tetra-methylene phosphonic acid,
ethylene diamino tetra-methylene phosphonic acid,
1,2-cyclohexane diamino tetra-methylene phosphonic acid,
1-amino methyl cyclopentyl amino(2)-tetra-methylene phosphonic acid,
N-phosphon o methane-1-amino ethane-1,1-diphosphonic acid,
1-amino ethane-1,1-diphosphonic acid,
acetamidin o ethane diphosphonic acid, and bis-N-carboxy methane amino ethane diphosphonic acid.

21. The process of claim 1, wherein said amino alkylene phosphonic acid is nitrilo trismethylene phosphonic acid, ethylene diamino-tetra-methylene phosphonic acid, diethylene triamino penta-methylene phosphonic acid or N-dicarboxymethylene-1-aminoethane-1,1-diphosphonic acid.

22. The process of claim 1, wherein said water soluble additive consists of said alkylene amino phosphonic acid compound.

* * * * *